US005325590A

United States Patent [19]

Andis et al.

[11] Patent Number: 5,325,590

[45] Date of Patent: Jul. 5, 1994

[54] HAIR TRIMMER HAVING A LOW-FRICTION ROTARY DRIVE

[75] Inventors: Matthew L. Andis, Racine; John Piwaron, Milwaukee, both of Wis.

[73] Assignee: Andis Company, Racine, Wis.

[21] Appl. No.: 28,271

[22] Filed: Mar. 9, 1993

[51] Int. Cl.[5] ..... B26B 19/02; B26B 19/06; B26B 19/00

[52] U.S. Cl. ..... 30/216; 30/34.1; 30/43.92

[58] Field of Search ..... 30/215, 216, 217, 218, 30/219, 74.1, 43.92

[56] References Cited

U.S. PATENT DOCUMENTS 3,074,161 1/1963 Liska .
3,178,818 4/1965 Liska .
3,399,454 9/1968 Liska .
3,423,826 1/1969 Liska .
3,460,250 8/1969 Liska .
3,815,232 6/1974 Liska .
4,219,930 9/1980 Franko et al. .
4,380,121 4/1983 Naimer et al. .
4,408,392 10/1983 Naimer .
4,581,822 4/1986 Fujimura ..... 30/216
4,649,642 3/1987 Nagasaki et al. .
4,803,780 2/1989 Locke et al. .
4,805,300 2/1989 Miska ..... 30/34.1
4,896,420 1/1990 Locke .
5,054,199 10/1991 Ogawa et al. ..... 30/216
5,088,200 2/1992 Piwaron et al. ..... 30/216
5,159,755 11/1992 Jestadt et al. ..... 30/43.92

*Primary Examiner*—Richard K. Seidel
*Assistant Examiner*—Paul M. Heyrana
*Attorney, Agent, or Firm*—Michael, Best & Friedrich

[57] ABSTRACT

A hair trimmer comprising a body, a cutting assembly supported by the body and having a reciprocable cutter, a drive mechanism for reciprocating the cutter, the drive mechanism including a rotating cam, a drive lever engaged with the cam and with the cutter, and a hinge element for flexibly supporting the drive lever in engagement with the cutter and with the cam, the hinge element including a base fixed to the body, a bar fixed to the drive lever and a hinge arm extending between the base and the bar, the hinge arm including a first web and a second web closely spaced to and parallel with the first web.

8 Claims, 3 Drawing Sheets

HAIR TRIMMER HAVING A LOW-FRICTION ROTARY DRIVE

BACKGROUND OF THE INVENTION

1. Technical Field

The invention relates generally to hair trimmers and to electric shavers having hair trimmers, and more particularly to hair trimmers and electric shavers having rotary drives.

2. Related Prior Art

The provision of a hair trimmer including a rotary drive for actuating an associated cutting assembly is generally known in the hair trimmer art and in the related art of electric shavers. Attention is directed to the following U.S. Patents which illustrate various hair trimmers and electric shavers having a rotary drive for actuating a cutting assembly:

| | | |
|---|---|---|
| 3,074,161 | Liska | January 22, 1963 |
| 3,178,818 | Liska | April 20, 1965 |
| 3,399,454 | Liska | September 3, 1968 |
| 3,423,826 | Liska | January 28, 1969 |
| 3,460,250 | Liska | August 12, 1969 |
| 3,815,232 | Liska | June 11, 1974 |
| 4,219,930 | Franko et al. | September 2, 1980 |
| 4,380,121 | Naimer et al. | April 19, 1983 |
| 4,408,392 | Naimer | October 11, 1983 |
| 4,803,780 | Locke et al. | February 14, 1989 |
| 4,896,420 | Locke | January 30, 1990 |

It is also generally known to provide such rotary drives with a mechanism for converting the rotary motion of a drive shaft to a reciprocal, linear motion for actuating a cutting assembly. The provision of such a motion-converting mechanism having a thin-walled segment or living hinge is also generally known. Attention is directed to the following U.S. Patents which illustrate various electric shavers having a living hinge for converting the rotary motion of a drive shaft to a reciprocal, linear motion for actuating a cutting assembly:

| | | |
|---|---|---|
| 4,649,642 | Nagasaki et al. | March 17, 1987 |
| 4,805,300 | Miska | February 21, 1989 |
| 5,088,200 | Piwaron et al. | February 18, 1991 |

SUMMARY OF THE INVENTION

The invention provides an electric hair trimmer including an electrically-powered rotary drive adapted to impart a reciprocating motion to a cutting assembly, and a hinge element for supporting and guiding a portion of the rotary drive. More particularly, the trimmer includes a cutting head assembly having a reciprocable cutter. The trimmer also has an electric motor which rotates a drive shaft and a cam on the drive shaft. A drive member engages the cam and also operably engages the reciprocable cutter.

The hinge element supports the drive member in engagement with the cam and guides the drive member so that rotation of the cam results in reciprocating linear movement of the drive member. The hinge element includes thin-walled segments of plastic or living hinges which have the capacity to absorb the energy of repeated flexing.

Under some operating conditions, rearward loading on the cutting assembly can slightly deflect the drive member, thereby placing a resultant strain on the living hinges. In order to resist rearward deflection, the living hinges require a certain degree of rigidity in the direction of loading. Such rigidity can be realized by increasing the thickness of the thin-walled segments of the living hinges. However, such an increase in wall thickness can proportionally decrease the capacity of the living hinge to absorb flexing energy.

In order to balance these competing design criteria, the hinge element includes a drive member support, a base fixed to the trimmer, and two hinge arms, each including multiple pair living hinges, and each extending between the base and the drive member support. The hinge arms support the drive member in position and also flex in response to eccentric rotation of the cam.

The hinge arms include multiple thin-walled sections that are integrally joined and arranged to provide a compound living hinge. Each of the multiple thin-walled segments have a relatively high capacity to absorb flexing energy. In addition, the pairs of living hinges are arranged to resist rearward deflection caused by loading on the cutting assembly while having a capacity to absorb flexing energy.

The invention provides a hair trimmer including a body, a cutting assembly supported by the body and having a reciprocable cutter, drive means for reciprocating the cutter, the drive means including a rotating cam, a drive lever engaged with the cam and with the cutter, and a hinge element for flexibly supporting the drive lever in engagement with the cutter and with the cam, the hinge element including a base fixed to the body, a bar fixed to the drive lever and a hinge arm extending between the base and the bar, the hinge arm including a first web and a second web closely spaced to and parallel with the first web.

The invention also provides a hair trimmer for use with a cutting head assembly having a reciprocable cutter, the trimmer comprising a body, a motor housed by the body, a rotatable shaft driven by the motor, a cam supported by the shaft for eccentric rotation, a drive member engaged with the cam, a drive lever extending from the drive member and being adapted to operably engage the reciprocable cutter, and a hinge supported by the body and supporting the drive member for lateral reciprocable movement relative to the body, the hinge including a plurality of webs each having a respective end, the respective ends of the plurality of webs being integrally formed.

The invention also provides a hair trimmer for use with a cutting head assembly having a reciprocable cutter, the trimmer comprising a body, drive means for reciprocating the cutter, the drive means including a reciprocable drive member, and hinge means supported by the body and supporting the drive member for reciprocal movement in a plane relative to the body, the hinge means including a hinge arm having opposite ends respectively connected to the body and the drive member, and the hinge means including a pivot for affording lateral reciprocal movement of the hinge arm and for preventing deflection of the drive member away from the plane.

The provision of a hinge element including an arrangement of multiple thin-walled segments that are flexible in one direction and that provide rigidity in a second direction, meets the criteria for a hinge element design that is both flexible and that is resistant to failure due to fatigue caused by flexing under the operational loads of a hair trimmer.

Various other features and advantages of the invention will become apparent to those skilled in the art upon review of the following detailed description, claims and drawings.

Figure 1:
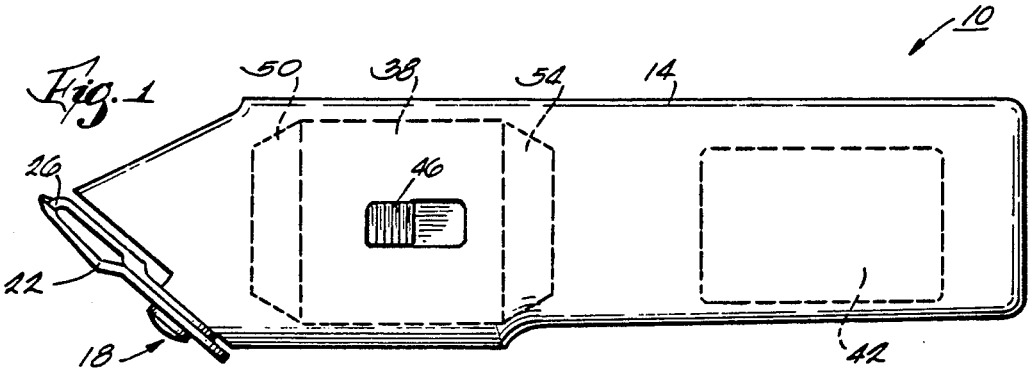
FIG. 1 is a side elevation view of an electric hair trimmer embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DESCRIPTION OF THE PREFERRED EMBODIMENT

The drawings illustrate an electric hair trimmer 10 having an easily hand-held body 14. Preferably, the body 14 is made of a light-weight, rigid plastic and is generally hollow.

A blade set or cutting head assembly 18 is supported at one end of the trimmer body 14. The trimmer 10 also includes a cutting head assembly 18 that is fixed to the body 14 by a fastener. However, the invention can also be applied to trimmers having a removable cutting assembly. U.S. Pat. No. 5,092,048, which issued on Mar. 3, 1992 to Sukow et al., illustrates one such removable cutting head assembly.

The cutting head assembly 18 includes a lower plate 22 and an upper plate or cutter 26 which is supported on the lower plate 22 and which is movable with respect to the lower plate 22. The cutter 26 defines (FIG. 2) a drive socket 30 which, as fully explained below, receives a reciprocating drive mechanism.

The trimmer 10 also includes rotary drive means 34 housed by the body 14 for reciprocating the cutter 26. While various constructions could be successfully employed, the illustrated rotary drive 34 includes an electric motor 38 which is housed by the trimmer body 14 and which is operably connected to a suitable source of electric current 42. In FIG. 1, the source of current 42 is schematically represented by a battery. However, the electric motor 38 could also be connected by an electric cord extending from the body 14 to a suitable source of power. A user operable thumb switch 46 for turning the electric motor 38 "on" and "off" extends from the trimmer body 14.

Figure 5:
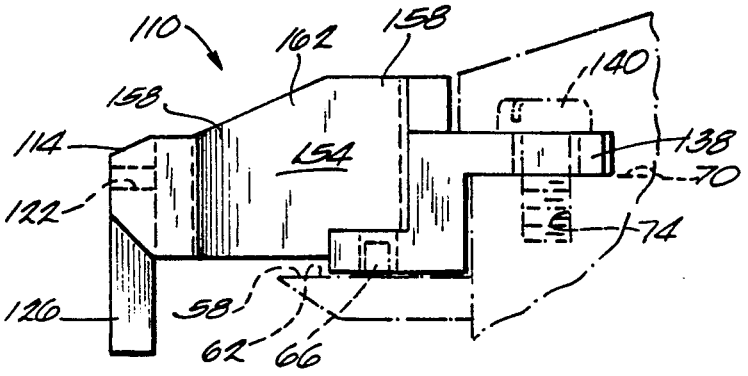
FIG. 5 is a side elevation view of the hinge element illustrated in FIG. 3 mounted on the trimmer.
Figure 6:
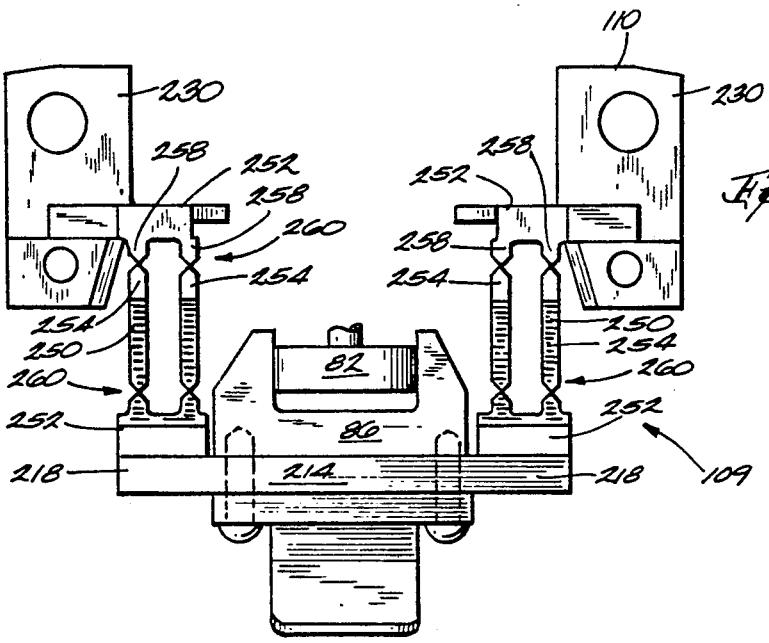
FIG. 6 is a view similar to FIG. 2 illustrating a second embodiment of the invention.
Figure 7:
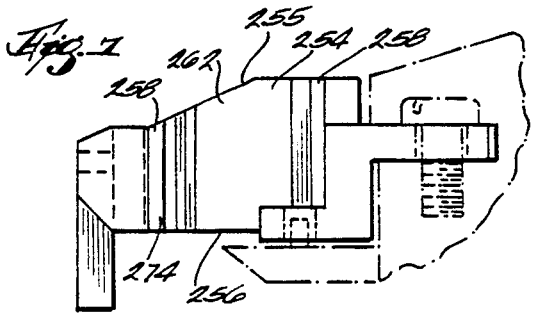
FIG. 7 is a side elevation view of the hinge element illustrated in FIG. 6 mounted on the trimmer.
Figure 9:
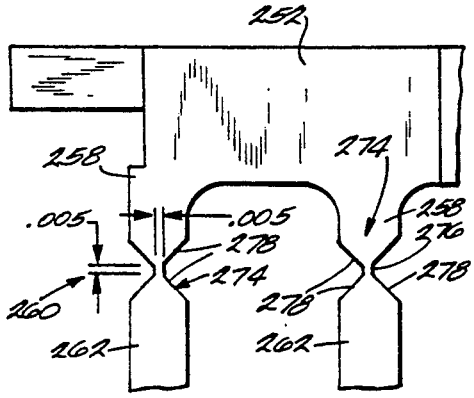
FIG. 9 is an enlarged view of a portion of the hinge element shown in FIG. 6.
Figure 8:
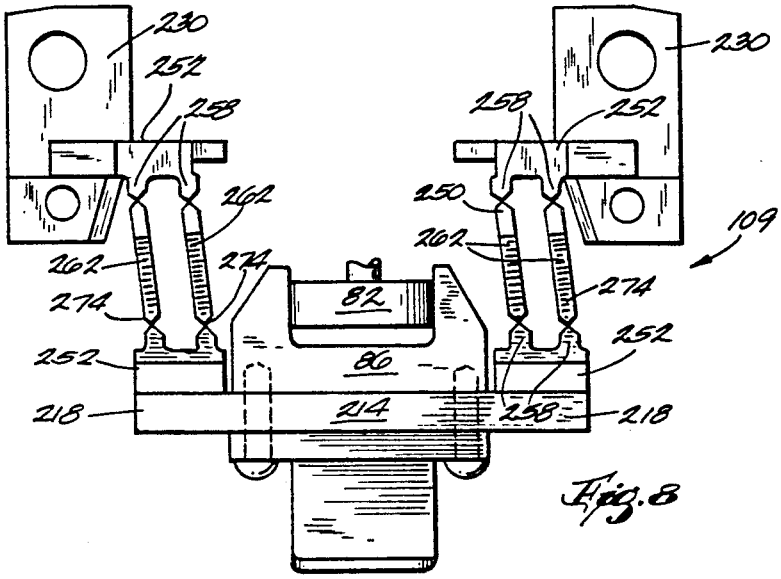
FIG. 8 is a view of the hinge element illustrated in FIG. 6 shown in a second position.

The rotary drive 34 also includes a front motor frame 50 (shown in phantom in FIG. 5) and a rear motor frame 54, each of which are fixed respectively to the front and rear ends of the electric motor 38 and which are fixed to the body 14. The front motor frame 50 secures the electric motor 38 to the body 14, and defines a pair of hinge mounting surfaces 58 (only one of which is shown in FIG. 5). Each hinge mounting surface 58 includes a generally planar first portion 62 having extending upwardly therefrom a location pin 66, and a generally planar second portion 70 having therein a hole 74.

The rotary drive 34 also includes (FIG. 2) a drive shaft 78 which extends forwardly from, and which is driven by, the electric motor 38. The forward end of the drive shaft 78 extends through and past the front motor frame 50 and supports a cam 82. The cam 82 is generally cylindrical and is fixed to the drive shaft 78 by a connecting pin which is offset from the axis of rotation of the drive shaft 78. When the drive shaft 78 rotates, the cam 82 rotates eccentrically about the axis of the drive shaft 78 due to the offset location of the connecting pin with respect to the axis of rotation.

The rotary drive 34 also includes (FIGS. 2 and 4) a drive member 86 engaged with the cam 82. The drive member 86 includes a rear plate 90 and a pair of cam followers 94 extending rearwardly from the rear plate 90. The cam followers 94 (FIG. 2) provide respective follower surfaces 98 which are in mutually opposed facing relation. The follower surfaces 98 are sufficiently spaced-apart to slidingly engage opposite sides of the cam 82.

The drive member 86 also includes a front plate 102 which is spaced from the rear plate 90 and which is connected thereto by means of a bight portion (not shown) extending between the lower portions of the front and rear plates 102, 94. A pair of holes 104 (shown in FIG. 4) extend through the front and rear plates 102, 94, and house a pair of fasteners 106 for reasons explained below. The drive member 86 also includes a drive lever 108 which extends forwardly from the bight portion below the front plate 102 and which engages the drive socket 30 in the cutter 26.

The trimmer 10 thus far disclosed is described in greater detail by the above identified U.S. Pat. No. 5,088,200 which issued to Piwaron et al. on Feb. 18, 1991, and which is incorporated herein by reference.

The trimmer 10 also includes hinge means 109 supported by the trimmer body 14 and supporting the drive member 86 for reciprocable movement in a plane relative to the body 14. While various suitable constructions could be employed, in the embodiment shown in FIGS. 2–5, the hinge means 109 includes a hinge element 110. The hinge element 110 includes a drive member support or cross-bar 114 having opposite ends 118 and located in the space between the front plate 102 and rear plate 90 of the drive member 86. A pair of holes 122 extend through the cross-bar 114 and register with the holes 104 extending through the front and rear plates 102, 94 of the drive member 86. The pair of fasteners 106 fix the drive member 86 to the cross-bar 114. A pair of legs 126 extend downwardly from the cross-bar 114 to form a drive lever clip which engages the bight portion of the drive member 86.

The hinge element 110 also includes a pair of base plates 130. Each base plate 130 has a generally planar bottom surface overlying a respective hinge mounting surface 58 and each has extending therethrough a first hole 134 receiving a respective location pin 66. Each base plate 130 also includes a flange 138 having extending therethrough a second hole 142 which (FIG. 5), registers with the hole 74 in the second portion 70 of the hinge mounting surface 58. A screw 140 extends through the hole 142 and secures the base plate 130 to the front motor frame 50.

Figure 2:
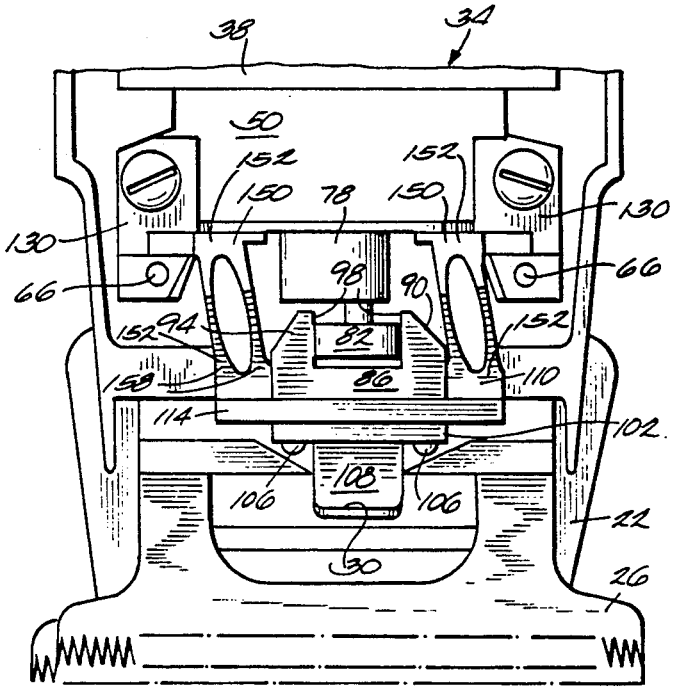
FIG. 2 is an enlarged view of a portion of the electric hair trimmer illustrated in FIG. 1.
Figure 3:
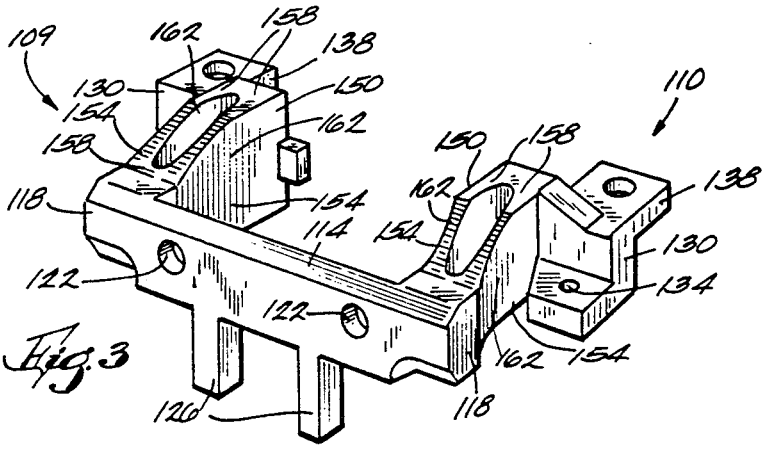
FIG. 3 is a perspective view of a hinge element included in the electric hair trimmer illustrated in FIG. 2.
Figure 4:
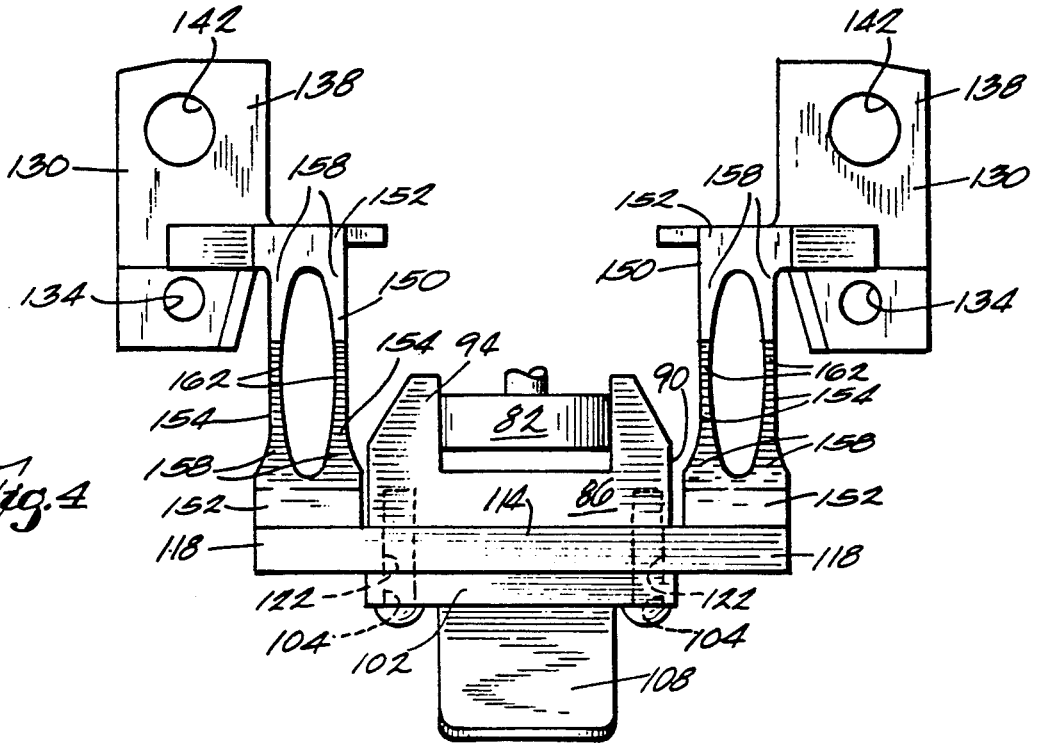
FIG. 4 is a plan view from above of the hinge element illustrated in FIG. 3 and including a portion of the rotary drive.

The hinge element 110 also includes two hinge arms 150 respectively extending between the base plates 130 and the opposite ends 118 of the cross-bar 114. As best shown in FIGS. 2 and 4, each hinge arm 150 has opposite ends 152 respectively connected to a base plate 130 and an end 118 of the cross-bar 114. Each hinge arm 150 is compound living hinge having multiple generally parallel and closely spaced thin-walled segments or webs 154 extending between the opposite ends 152. In the illustrated embodiments of the hinge element 110, each hinge arm 150 includes two webs 154. However, it should be readily understood that additional webs 154 could be included in each hinge arm 150. Each web 154 has opposite ends 158 that join with the respective ends 158 of adjacent webs 154 to form the end 152 of the hinge arm 150. Each web 154 also has an intermediate, thin-walled section 162 extending between the opposite ends 158.

The hinge arms 150 are preferably integrally formed with the base plates 130 and the cross-bar 114 and have a relatively high capacity to absorb the energy of repeated reciprocal flexing without failing due to fatigue. Preferably, the hinge element 110, including the base plates 130, the cross-bar 114, and the hinge arms 150, is an integrally formed plastic unit. Polypropylene, for example, can be used as a material for the hinge element 110. The intermediate sections 162 of the webs 154 are relatively thin so that the webs 154 have a high capacity to absorb energy from lateral flexing of the hinge arms 150, i.e. flexing of the hinge arms 150 in a direction generally normal to the planar intermediate sections 162. However, each web 154 also has a sufficient height substantially greater than its thickness so as to be relatively rigid in a direction generally parallel to the width.

When assembled (FIG. 2) with the front motor frame 50 and the drive member 86, the hinge element 110 flexibly support the cross-bar 114 to afford lateral movement of the drive member in a plane relative to the trimmer body 14. The hinge element 110 also supports the cross-bar 114 so that the cam follower surfaces 98 and the drive lever 108 respectively engage the cam 82 and the drive socket 30. During operation of the trimmer 10, the motor 38 rotates the drive shaft 78 and causes eccentric rotation of the cam 82. The follower surfaces 98 slidingly engage the cam 82 and move laterally from side to side as the cam 82 rotates eccentrically. As a result, the hinge arms 150 flex laterally to afford reciprocal linear displacement of the drive member 86 and the cross-bar 114 in a plane of movement. The eccentric rotation of the cam 82 is thus converted into a reciprocal linear motion by the hinge element 110.

Under operating conditions wherein the cutting head assembly 18 is under a relatively heavy load, the drive lever 108 can be deflected rearwardly. In reference to FIG. 2, such rearward loading would be directed normal to, and out of, the page. Under such operating conditions, the hinge element 110 controls and prevents any rearward deflection of the drive member 86 from its plane of movement by virtue of the rigidity of the hinge arms 150 in the direction of loading. In particular, the arrangement of multiple webs 154, each of which are relatively thin for flexibility in one direction, into a compound living hinge provides rigidity in the direction of rearward loading and provides a hinge element that is flexible and resistant to failure due to fatigue caused by flexing under operational loading.

FIGS. 6–9 illustrate a second embodiment of the invention, including the hinge means 109 supported by the trimmer body 14 and supporting the drive member 86 for reciprocal movement in a plane relative to the body 14. The hinge means 109 shown in FIGS. 6–9 includes a hinge element 210 including a cross-bar 214 having opposite ends 218 and a pair of base plates 230. The hinge element 210 also includes a pair of hinge arms 250, each having opposite ends 252 respectively connected to one of the base plates 230 and to an end 218 of the cross-bar 214. The hinge arms 250 also include a plurality of webs 254 that are generally parallel, are closely-spaced apart, and that extend between the opposite ends 252 of the hinge arms 250. The webs 254 each have (FIG. 7) upper and lower-edges 255 and 256, opposite ends 258 and an intermediate section 262 extending between the ends 258 and having a substantially uniform thickness.

The hinge means 109 shown in FIGS. 6–9 also includes pivot means 260 for affording lateral reciprocal movement of the hinge arms 250 and for preventing deflection of the drive member 86 away from its plane of movement. While various suitable constructions for the pivot means 260 can be employed, in the embodiment shown in FIGS. 6–9, the pivot means 260 includes a pivot 274 located in the intermediate section 262 and adjacent an opposite end 258 of a web 254. In the illustated embodiment, the the pivot means 260 includes a pair of pivots 274 arranged in series along a web 254 and located adjacent the ends 258 of the web 254. Each pivot 274 includes a section of the web 254 or a flat 276 extending between the upper and lower edges 255, 256 of the web 254 and having a thickness substantially less than the thickness of the web 254 adjacent the pivot 274.

The thickness of the intermediate section 262 of the web 254 relative to that of the flat 276 is great enough to limit flexing of the intermediate section 262 during trimmer operation, and to afford pivotal movement of the intermediate section 262 of the web 254 about the axis defined by the flat 276 adjacent the end of the web 254. A ratio of intermediate section thickness to flat thickness is preferably approximately 6:1 and can be attained by providing a flat having a thickness of approximately 0.005 inches and a web thickness of approximately 0.030 inches. Also, the flat 276 extends minimally along the length of the web 254. In the illustrated embodiment, the a flat has a length of approximately 0.005 inches.

Each pivot 274 also includes a relatively precipitous transition portion 278 extending between the intermediate portion 262 of the web 254 and the flat 276. The transition portion 278 decreases rapidly and equally from both sides of the web 254 along an angle of approximately 45°.

Like the hinge element 110, the hinge element 210, including the webs 254, is also preferably integrally formed of a suitable plastic, such as polypropylene. The pivots 274 can be formed by heating and compressing the intermediate section 262 of web 254 to form the pivot 274.

The pivots 274 allow the webs 254 to rotate relative to the respective ends 252 of the hinge arms 250 and allow lateral displacement of the drive member 86 in a plane. The provision of a pivot 274 adjacent each of the opposite ends 258 of the webs 254 localizes the area receiving the energy of reciprocal support of the drive member 86. The localization of pivoting movement in the hinge arm 250 focuses the heat caused by repeated lateral deflection of the web 254 in the area of the pivot 274. Also, the compressed nature of the pivot 274 provides rigidity to the hinge arm 250 in the direction perpendicular to the plane in which of the drive member can move.

Various features of the invention are set forth in the following claims.

We claim:

1. A hair trimmer for use with a cutting head assembly having a reciprocable cutter, said trimmer comprising a body, drive means for reciprocating the cutter, said drive means including a reciprocable drive member, and hinge means supported by said body and supporting said drive member for reciprocal movement in a plane relative to said body, said hinge means including an elongated hinge arm having opposite ends respectively connected to said body and said drive member and having a cross section transverse to said elongation with a height and a first thickness, and said hinge arm including, intermediate said opposite ends, a pivot for affording lateral reciprocal movement of said hinge arm and for preventing deflection of said drive member away from said plane, said pivot comprising a portion of said hinge arm having a second thickness which is substantially reduced in comparison to said first thickness and which extends in the direction of elongation for a distance about equal to said second thickness.

2. A hair trimmer as set forth in claim 1 wherein said hinge means includes a plurality of said hinge arms.

3. A hair trimmer as set forth in claim 1 wherein said hinge arms are closely spaced apart between the opposite ends thereof and are generally parallel.

4. A hair trimmer as set forth in claim 1 wherein said hinge arm includes a central elongated web having opposite ends, wherein said pivot connects one of said opposite ends of said central web and with one of said opposite ends of said hinge arm, and further including a second pivot connecting the other of said opposite ends of said central web and the other of said opposite ends of said hinge arm, said second pivot comprising a portion of said hinge arm having a first thickness which is substantially reduced in comparison to said first thickness and which extends in the direction of elongation for a distance about equal to said thickness of said second pivot.

5. A hair trimmer as set forth in claim 4 wherein said web has a generally uniform thickness substantially greater than said thickness of said pivots.

6. A hair trimmer as set forth in claim 5 wherein said pivots extend for a height equal to said height of said hinge arm.

7. A hair trimmer as set forth in claim 5 wherein said hinge arm has a relatively precipitous transition between said web and said pivots.

8. A hair trimmer as set forth in claim 5 wherein the ratio of said thickness of said web to said thickness of said pivot is approximately 6:1.

* * * * *